United States Patent [19]

Drapaniotis

[11] 4,202,358

[45] May 13, 1980

[54] FILTER FOR CIGARETTES WITH TWO CHAMBERS

[76] Inventor: Dimitrios Drapaniotis, Menelaou 15-17, Ilioupolis, Athens, Greece

[21] Appl. No.: 928,378

[22] Filed: Jul. 27, 1978

[30] Foreign Application Priority Data

Apr. 4, 1978 [GR] Greece ..... 60479

[51] Int. Cl.[2] ..... A24F 13/04

[52] U.S. Cl. ..... 131/187; 131/201; 131/210; 131/216

[58] Field of Search ..... 131/187, 210, 201, 216, 131/198

[56] References Cited

U.S. PATENT DOCUMENTS

| | | | |
|---|---|---|---|
| 1,890,920 | 12/1932 | Strawn | 131/210 |
| 3,062,220 | 11/1962 | Brothers | 131/210 X |
| 3,174,487 | 3/1965 | Missler | 131/187 |
| 3,434,480 | 3/1969 | Dailey | 131/201 X |
| 3,468,316 | 9/1969 | Baum et al. | 131/187 |
| 3,756,251 | 9/1973 | Terasaki | 131/187 |

*Primary Examiner*—Stephen C. Pellegrino

*Attorney, Agent, or Firm*—Armstrong, Nikaido, Marmelstein & Kubovcik

[57] ABSTRACT

The invention is directed to a filter for removing cigarette smoke particles. The filter is comprised of a housing having an inlet and an outlet. A first diaphragm is positioned adjacent the housing inlet and a second diaphragm is positioned midway along the length of the housing and dividing the filter into forward and rearward chambers. At least one smoke particle condensing surface is positioned within each of the forward and rearward chambers. The smoke particles condensing surface provides additional surface upon which the particles condense after passing through at least the first diaphragm.

2 Claims, 4 Drawing Figures

FILTER FOR CIGARETTES WITH TWO CHAMBERS

BACKGROUND OF THE INVENTION

The mechanical holding of said substances, which are oily, is achieved by passing the smoke through successive diaphragms with tubes and through two chambers with surfaces at which the smoke falls and which divert the smoke which is inhaled from the burning cigarette. Simultaneously the holding of such oily substances is also achieved by the solidification to which the substances are subjected during their obligatory paning through the tubes, diaphragms and the two chambers and consequently part of the cooled molecules stick to the inner surface of the chambers, diaphragms and surfaces at which the smoke falls.

DESCRIPTION OF THE PRIOR ART

Up-to-date technology has made several types of filters for cigarettes, based so as part of the oily substances of burning (pitch and other remaining substances) are restrained.

However the up-to-date constructions are limited to simple tubes or eventually to the creation of a chamber at the inner surface of which the inhaled smoke falls and which holds a small part of the oily substances which it contains. The holding of the oily substances by the up-to-date made filters is not satisfactory and this is proved by making the following test: Soaking up smoke by using the up-to-date constructed pipes and after holding it in the mouth, to puff it on a white piece of paper held in contact with our mouth. The paper becomes yellow, and darker yellow when the smoke contains more oily substances (pitch.).

SUMMARY OF THE INVENTION

An object of this invention is to provide a cigarette filter which will hold much more of the oily substances and which will reduce essentially the percentage of the harmful substances from the inhaled smoke as can be visibly demonstrated by test described above.

The retaining of the harmful substances is achieved while the smoke passing through the filter, the smoke does not follow a straight line toward the mouth of the filter, but remains for a longer period in the two chambers, panes through several tubes being installed in different levels and falls at the two additional levels which are installed into the chambers with the result that the smoke covers a larger distance comes into contact with a larger surface of the filter body where large quantities of coal molecules are held. On the other hand, because of the large distance and the larger inner surface, the oily ingredients of burning have plenty of time to be cooled and to be concentrated on the inner side and surfaces of the filter at which the smoke falls.

BRIEF DESCRIPTION OF THE DRAWINGS

These and other objects and advantages will become more fully apparent as the following description is read in conjunction with the drawings wherein.

DETAILED DESCRIPTION OF THE PREFERRED EMBODIMENT

Figure 2:
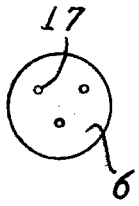
FIG. 2 is a plan view of the second diaphragm showing the preferred arrangement of the apertures.
Figure 1:
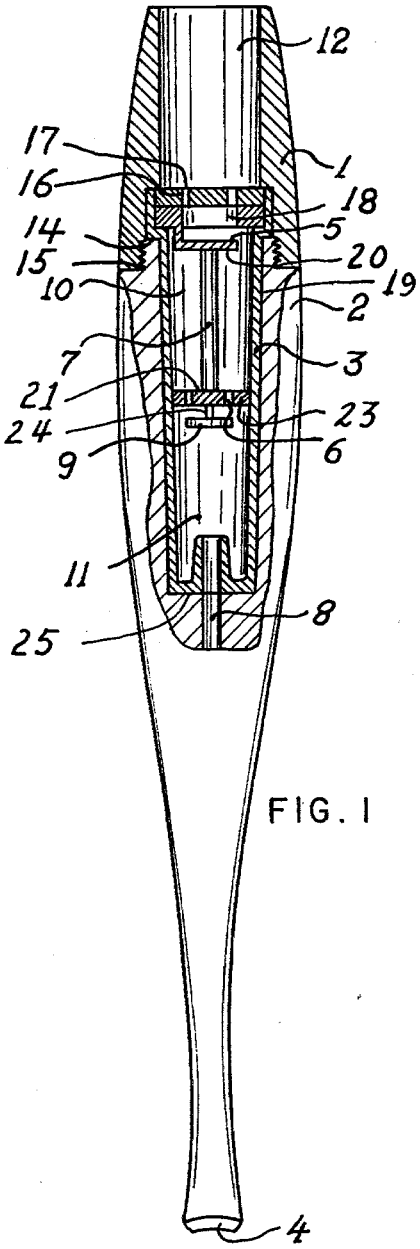
FIG. 1 is a top plan view partially in section, of the preferred embodiment of the cigarette filter of the present invention.

The head of the filter 1 includes a portion 12 for receiving a cigarette. Opposite the head cigarette receiving portion 12 is a threaded portion 14 adapted for threadly mating with a cooperating threaded portion 15 of a main filter body 2.

Within the main filter body 2 is a longitudinally extending chamber 19 adapted for reception of a filter assembly 3.

Figure 4:
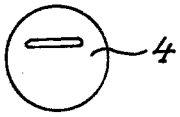
FIG. 4 is an end view of the preferred main filter body mouthpiece.

The main filter body opposite the small filter chamber forms a mouthpiece 4. The preferred configuration of the mouthpiece is more clearly illustrated in FIG. 4.

A first diaphragm 16 which includes a plurality of longitudinally extending apertures 17 is provided rearwardly adjacent to the head cigarette receiveing portion 12.

Positioned rearwardly adjacent to the first diaphragm 16 is centrally positioned partial barrier 5.

Attached to a rear surface 20 of the partial blockade 5 is a longitudinally rearwardly extending rod-like member 7. Attached to and supported by a rearward portion 21 of the rod-like member 7 is a second diaphragm 6 which includes a plurality of longitudinally extending apertures 23.

A first chamber 10 is formed by the partial barrier 5, the interior surface of the filter 3 and the second diaphragm 6. The various surfaces forming the first chamber 10 provide a recepticle for the condensed cigarette smoke molecules.

To the rearmost end 24 of the rod-like member 7 is mounted a disk member 9 which forms an additional surface upon which the smoke particles will condense, and which provide a forward wall of a second chamber 11.

A longitudinally extending passage 8 is provided within the main filter body 2 for providing communication between a rear end 25 of the filter 3 and the mouthpiece 4.

Figure 3:
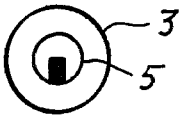
FIG. 3 is a plan view of the partial blockade.

FIG. 2 illustrates the preferred aperture arrangement of the second diaphragm 6; while FIG. 3 illustrates the positioning of the partial blockade within the filter 3.

The cigarette filter of the present invention can be constructed in any desired form, shape and size, the drawing attached herewith not consisting a restrictive form of the invention, but just a descriptional design. Any not essential modification of this drawing as well as any modification which does not constitute an invention idea and does not consist in new invention elements or does not contribute to the development of whatever is known, or does not contribute to the solution of existing technical problem, does not restrict the rights on this invention. For example, according to the constructional needs the filter may be divided into two or more pieces, fitted to each other, or more surfaces on which the smoke can fall can be added into the chambers.

I claim:

1. A filter for removing cigarette smoke particles comprising:

a housing having an inlet and an outlet;

a first diaphragm positioned adjacent said housing inlet;

a second diaphragm positioned midway along the length of said housing and dividing said filter into first and second chambers;

at least one smoke particle condensing surface means being positioned within each of said first and second chambers;

a longitudinal extending rod-like member, said rod-like member being connected at one end to said at least one smoke particle condensing surface means in said first chamber, and wherein a distal end portion of said rod like member supports said second diaphragm;

wherein said smoke particles condensing surface means provide additional surfaces upon which said particles condense after passing through at least said first diaphragm.

2. A filter for removing smoke as claimed in claim 1 wherein said at least one smoke particle condensing means in said second chamber is supported by a rearmost end of said rod-like member.

* * * * *